United States Patent [19]

Hatch

[11] Patent Number: 4,932,892

[45] Date of Patent: Jun. 12, 1990

[54] HIGH DENSITY CONNECTOR FOR END TERMINATING AND/OR DAISY CHAINING FLAT CABLE AND CABLE-CONNECTOR ASSEMBLY

[75] Inventor: David Hatch, Sherborn, Mass.

[73] Assignee: Stewart Connector Systems, Inc., Glen Rock, Pa.

[21] Appl. No.: 250,313

[22] Filed: Sep. 28, 1988

[51] Int. Cl.[5] ..... H01R 4/24

[52] U.S. Cl. ..... 439/395; 439/417

[58] Field of Search ..... 439/389, 391, 395, 396, 439/397, 417, 418

[56] References Cited

U.S. PATENT DOCUMENTS 4,713,025 12/1987 Soma ..... 439/391 X
4,753,608 6/1988 Yamaguchi ..... 439/395
4,781,615 11/1988 Davis et al. ..... 439/395

FOREIGN PATENT DOCUMENTS 0011923 6/1980 European Pat. Off. ..... 439/418

*Primary Examiner*—Z. R. Bilinsky
*Attorney, Agent, or Firm*—Steinberg & Raskin

[57] ABSTRACT

A connector for end terminating and/or daisy chaining flat multiconductor cable. The connector includes components for positioning a pair of first and second flat cables in substantially overlying relationship so that conductors of the second cable are situated essentially between pairs of adjacent conductors of the first cable. A plurality of first contacts engage the conductors of the first cable. A plurality of second contacts pierce the webs of insulation between adjacent pairs of conductors of the first cable and engage the conductors of the second cable.

30 Claims, 6 Drawing Sheets

FIG. 1
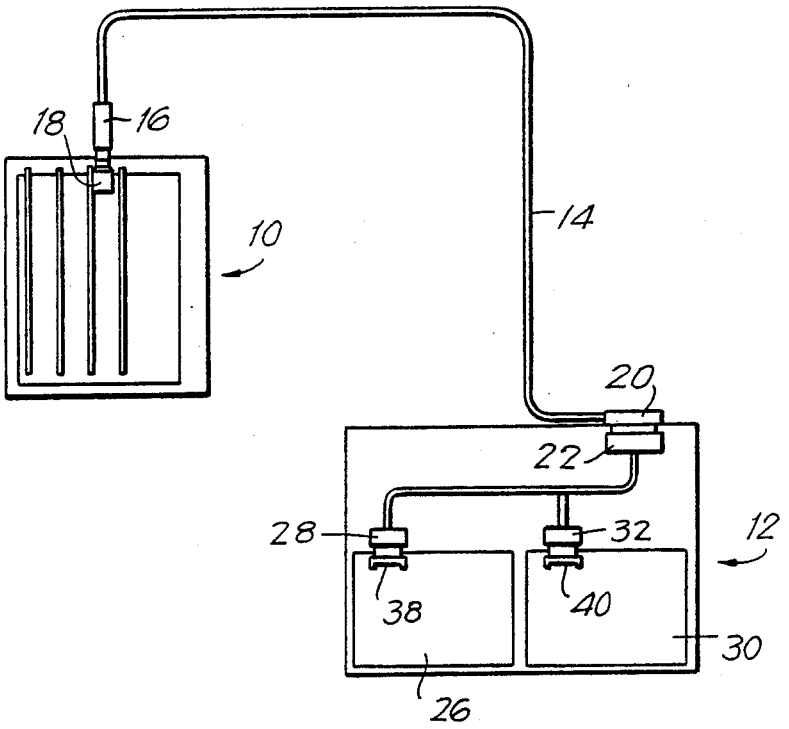
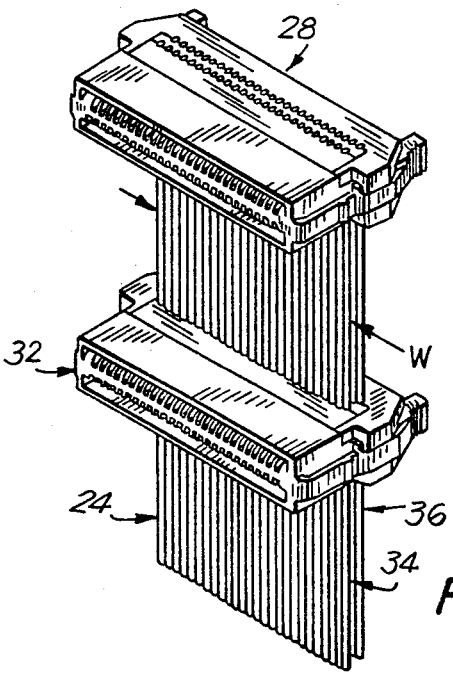
FIG. 2

FIG. 7A
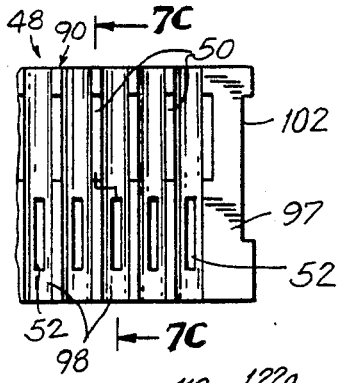
FIG. 7B
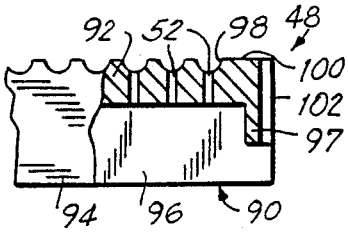
FIG. 7C
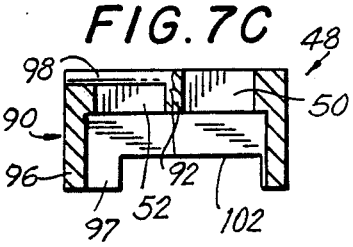
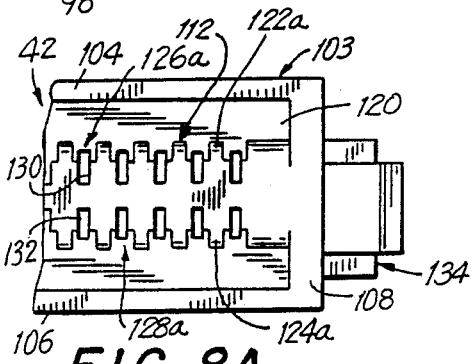
FIG. 8A
FIG. 8B
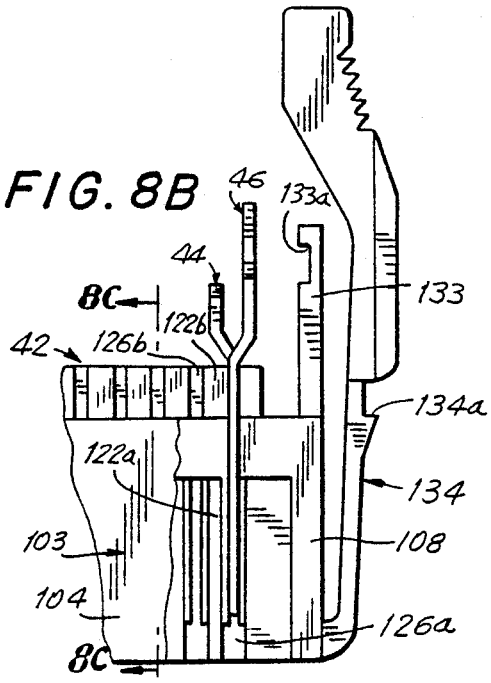
FIG. 8C
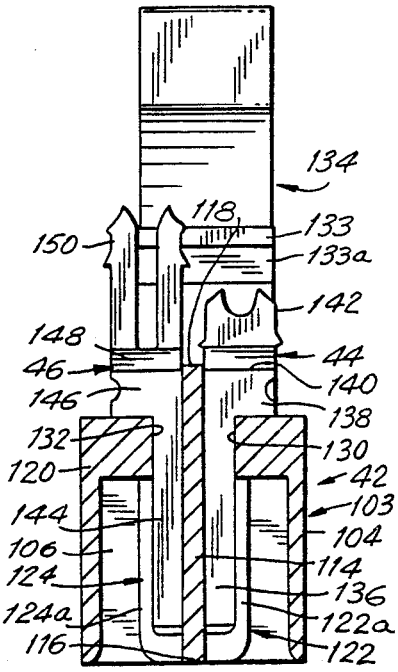

HIGH DENSITY CONNECTOR FOR END TERMINATING AND/OR DAISY CHAINING FLAT CABLE AND CABLE-CONNECTOR ASSEMBLY

BACKGROUND OF THE INVENTION

This invention relates generally to electrical connectors and, more particularly, to connectors for end terminating and/or daisy chaining flat or ribbon cable.

Flat cable is in common use in high density applications such as data transmission in which large quantities of data are electronically transmitted between various types of equipment. A flat cable generally comprises a plurality of spaced, parallel conductors embedded in insulation material. A conventional flat cable in widespread use, for example, has twenty-five parallel conductors spaced from each other on 0.050 inch centers embedded in a web of insulation having an overall width of about one and one-half inches. Such cable can be connected to equipment by terminating in a "dead end" connection where one end of the flat cable is joined to a connector, or by a "daisy chain" connection where a connector is joined to the flat cable between its ends. Connectors for flat cables are disclosed in U.S. Pat. Nos. 4,020,540, 4,228,709, 4,241,790, 4,393,580, and 4,687,263.

As technology progresses, the need for transmitting data faster and in greater quantities becomes more acute. In this regard, it generally would be desirable to increase the number of conductors carrying the data and it has been suggested in one case to use flat cable having as many as fifty or more conductors. Of course, if conventional inter-conductor spacing, e.g., 0.050 inches, is maintained, the width of the flat cable must increase. Conversely, if conventional cable widths are desired, it becomes necessary to space the parallel conductors closer to each other, e.g., on, 0.025 inch centers. Each approach, however, has drawbacks. In particular, the space available for cable connectors is frequently limited thereby imposing limitations on the width of the cable. On the other hand, electrical properties, such as characteristic impedance and cable cross-talk, of flat cables having conductors spaced at a fine pitch, are not compatible with many items of equipment for which their use is intended.

High density connectors for flat ribbon cables should also meet certain other design objectives. For example, a high density connector should be of a design which permits the cable terminating procedure to be fast and simple. It should be capable of both daisy chain as well as single ended connections. It should be able to mate with a connector whose height and width present a minimum profile. Further, the connector should be relatively simple in construction and economical in manufacture.

SUMMARY OF THE INVENTION

Accordingly, it is an object of the present invention to provide new and improved connectors for end terminating and/or daisy chaining flat cable.

Another object of the invention is to provide new and improved connectors for end terminating and/or daisy chaining flat cable having substantially conventional width and inter-conductor spacing and a greater than conventional number of conductors.

Still another object of the invention is to provide new and improved connectors which can be end terminated or daisy chained to flat cable in a quick and easy manner.

A further object of the invention is to provide new and improved connectors for end terminating and/or daisy chaining flat cable which are connectable with mating connectors whose height and width present a minimum profile.

A still further object of the invention is to provide new and improved connectors for end terminating and/or daisy chaining flat cable which are simple in construction and economical manufacture.

Yet another object of the invention is to provide a new and improved flat cable-connector assembly including a connector which terminates flat cable having a conventional width and inter-conductor spacing and yet which has an increased number of conductors.

Briefly, in accordance with the present invention, these and other objects are attained by providing a connector having a construction by which it can terminate all of the conductors of an arrangement of a pair of flat cables of conventional width and conductor pitch situated in mutually overlying or "stacked pair" relationship. By providing the flat cable to be terminated or daisy chained in an overlying or stacked pair arrangement, the number of conductors of the cable arrangement can be significantly increased (e.g., doubled from twenty-five to fifty) while the inter-conductor spacing or pitch in the lateral cable width direction (e.g., about 0.50 inches) remains the same as in each individual flat cable.

A connector in accordance with the invention includes means for positioning each of the pair of overlying cables so that the conductors of one cable are situated essentially between pairs of adjacent conductors of the other cable, i.e., in staggered relationship, a plurality of first contacts engaging the conductors of the first cable, and a plurality of second contacts passing through the webs of insulation between adjacent pairs of conductors of the first cable and engaging the conductors of the second cable.

DESCRIPTION OF THE DRAWINGS

A more complete appreciation of the present invention and many of the attendant advantages thereof will be readily understood by reference to the accompanying drawings illustrating preferred embodiments to which the invention is not to be limited, and in which:

FIG. 1 is a schematic illustration of a system utilizing connectors and cable-connector assemblies in accordance with the present invention;

FIG. 2 is a fragmentary perspective view of a pair of identical connectors in accordance with the invention terminated to a stacked pair flat cable arrangement to form a cable-connector assembly in accordance with the invention, the cable arrangement being terminated to one connector in a single or dead end connection, and to the other connector in a daisy chain connection;

FIG. 7A is a fragmentary rear elevation view of the guide member component of the connector shown in FIG. 2; FIG. 7B is a fragmentary top plan view partially cut away of the guide member component shown in FIG. 7A; and FIG. 7C is a section view taken along line 7C—7C of FIG. 7A;

FIG. 8A is a fragmentary front elevation view of the front member component of the connector shown in FIG. 2; FIG. 8B is a fragmentary top plan view partially cut away of the front member component of the connector; and FIG. 8C is a section view taken along front line 8C—8C of FIG. 8B;

DESCRIPTION OF THE PREFERRED EMBODIMENTS

Figure 3:
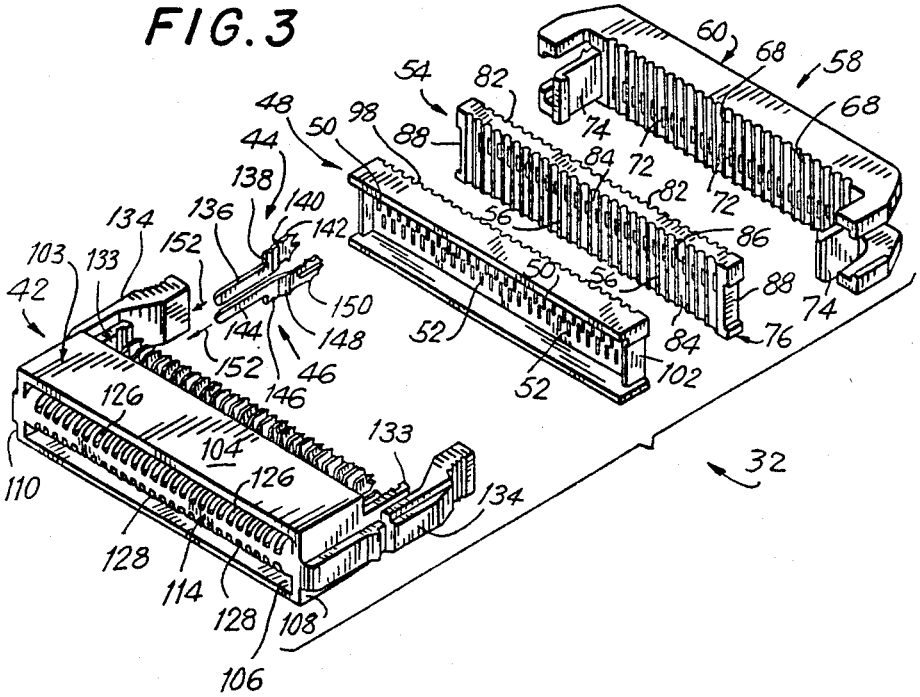
FIG. 3 is an exploded perspective view of the connector shown in FIG. 2.

Referring now to the drawings which show a preferred embodiment of the invention and wherein like reference characters designate identical or corresponding parts throughout the several views, and initially to FIG. 1, a typical system utilizing connectors and cable-connector assemblies in accordance with the invention comprises a data transmitting and receiving host 10 externally connected to a data transmitting and receiving device 12 by a cable or cable arrangement 14 having fifty conductors (in the illustrated embodiment) connected to the host 10 by a shielded connector 16 attached to a shielded, board-mounted header 18 and connected to the device 12 by a shielded plug 20 which mates with a shielded bulkhead connector 22. The cable 14 is coupled by a stacked pair cable arrangement 24 to a first internal board 26 in device 12 by a connector 28 in accordance with the invention which is "dead end" connected to cable arrangement 24 and which mates with a board header 38. The cable 14 is also coupled to a second internal board 30 through cable arrangement 24 by a connector 32 in accordance with the invention which is identical in construction to connector 28 and which is "daisy chain" connected to cable arrangement 24 and which mates with a board header 40.

Referring to FIG. 2, the cable arrangement 24 comprises a pair of flat cables 34 and 36 of conventional width W in mutually overlying relationship, i.e., in a stacked pair relationship. Each cable 34,36 includes twenty-five conductors 35,37 (FIGS. 4, 9 and 10) spaced from each other at a conventional pitch, namely 0.050 inches in the illustrated embodiment. The connector 32 includes means for positioning each of the pair of overlying cables so that the conductors 37 of cable 36 are situated essentially between pairs of adjacent conductors 35 of cable 34, i.e., the conductors of the respective cables are situated in a staggered relationship. As described below, in accordance with the invention a plurality of short upper connector contacts engage the conductors of first cable 34 while a plurality of longer lower connector contacts pass through the webs of insulation between adjacent pairs of conductors 35 of first cable 34 and engage the conductors 37 of second cable 36.

As best seen in FIG. 3, the connector 32 generally includes a front member 42 in which twenty-five short contacts 44 and twenty-five long contacts 46 (only one shown) are mounted in respective upper and lower parallel rows, a guide member 48 adapted to mate with the front member 42 having first upper and second lower parallel rows of twenty-five guide slots 50 and 52 formed therethrough, the twenty-five guide slots 50 of the upper row being staggered or alternating in position with respect to the twenty-five guide slots 52 of the lower row, a divider member 54 adapted to mate with the guide member 48 to hold the first flat cable 34 of cable arrangement 24 between them and having a single row of twenty-five slots 56 formed therethrough aligned with respective lower guide slots 52 of guide member 48, and a cover member 58 adapted to mate with the divider member 54 to hold the second flat cable 36 of cable arrangement 24 between them. The guide, divider and cover members 48, 54 and 58 are profiled as described below to provide means for positioning the conductors 35 and 37 of first and second cables 34 and 36 in alternating or staggered relationship with respect to each other. The contacts 44 and 46 are configured, and the guide slots 50,52 of guide member 48 and through-slots 56 of divider member 54 are so positioned and aligned with other and the conductor positioning means that the short upper contacts 44 pass from the front member 42 through respective upper guide slots 50 of guide member 48 to engage the conductors 35 of the first cable 34 while the long lower contacts 46 first pass from front member 42 through respective lower guide slots 52 of guide member 48, then through the webs of insulation material between pairs of adjacent conductors 35 of the first cable 34, then through the slots 56 of divider member 56 to engage the conductor 37 of the second cable 36.

Figure 5A:
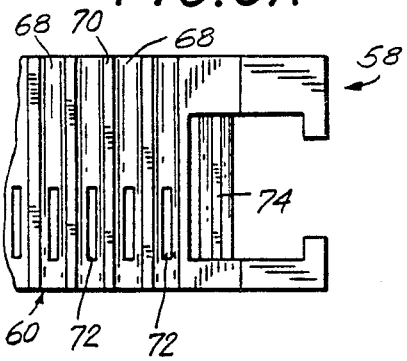
FIG. 5A is a fragmentary front elevation view of the cover member component of the connector shown in FIG. 2.
Figure 5B:
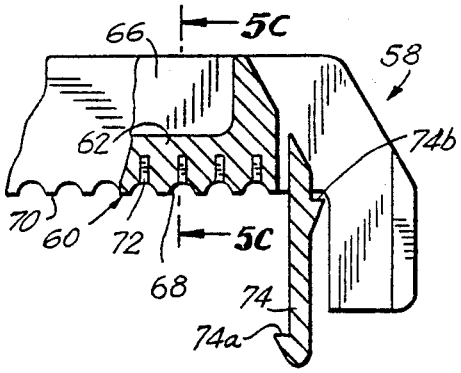
FIG. 5B is a fragmentary top plan view partially cut away of the cover member component shown in FIG. 5A.
Figure 5C:
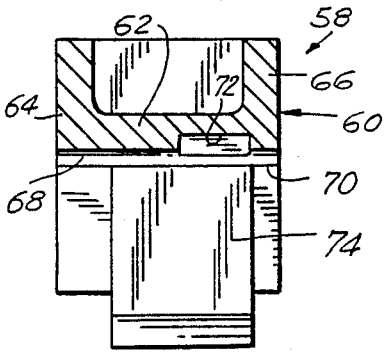
FIG. 5C is a section view taken along line 5C—5C of FIG. 5B.

Referring to FIGS. 5A–5C in conjunction with FIG. 3, the cover member 58 comprises a body 60 including a wall 62 and top and bottom rearwardly extending flanges 64 and 66. Twenty-five (in the illustrated embodiment) parallel channels 68 are formed adjacent to each other in the front surface 70 of wall 62, each channel 68 extending over the entire height of wall 62. The channels 70 are spaced at the same pitch as the conductors 37 of cable 36. A recess 72 is formed in wall 62 at the bottom of each channel 68. A locking arm 74 projects forwardly from each end region of body 60.

Figure 6A:
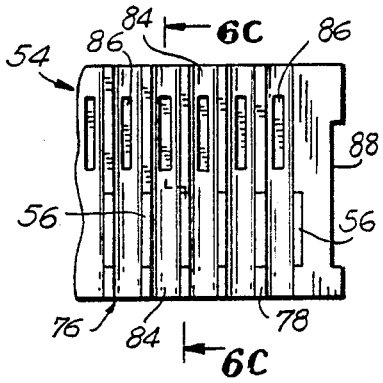
FIG. 6A is a fragmentary front elevation view of the divider member component of the connector shown in FIG. 2.
Figure 6B:
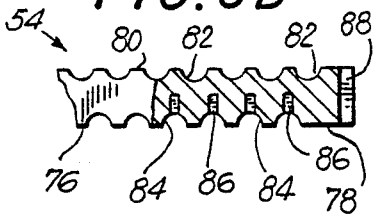
FIG. 6B is a fragmentary top plan view partially cut away of the divider member component shown in FIG. 6A.
Figure 6C:
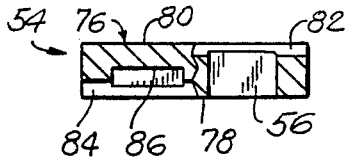
FIG. 6C is a section view taken along line 6C—6C of FIG. 6A.

Referring to FIGS. 6A–6C in conjunction with FIG. 3, the divider member 54 comprises a body 76 having front and rear surfaces 78 and 80. A series of parallel channels 82 corresponding in number to the number of channels 68 in cover member 58 are formed in the rear surface 80 of divider body 76 and are situated so as to align with them upon assembly of the connector components to precisely position the conductors 37 of cable 36 as described below. Twenty-five (in the illustrated embodiment) parallel channels 84 are formed in the front surface 78 of body 76. The channels 84 in front surface 78 are displaced or staggered with respect to the channels 82 in rear surface 80. As noted above, a series of divider guide slots 56 aligned with respective lower guide slots 52 of guide member 48 extend through divider body 76 in a row situated in a lower half of body 76. Each slot 56 opens onto front surface 78 between a pair of adjacent front channels 84 and onto rear surface 80 within a respective rear channel 82. A recess 86 is formed within each of the front channels 84 in the upper half of body 76 aligned with a respective one of the upper guide slots 50 of guide member 48. A notch 88 is formed in each end of divider body 76 of substantially the same height as locking arm 74 of cover member 58.

Referring to FIGS. 7A–7C in conjunction with FIG. 3, the guide member 48 comprises a body 90 including a wall 92, top and bottom forwardly extending flanges 94 and 96, and forwardly extending side flanges 97 at each end of wall 92. A series of parallel channels 98 corresponding in number to the front channels 84 of divider member 58 are formed in the rear surface 100 of guide member 48 and are situated so as to align with channels 84 upon assembly of the connector components to precisely position the conductors 35 of cable 34 as described below. As noted above, a series of vertical slots 50 extend through guide body 90 in a row situated in the upper half of body 90, each slot 50 opening into the bottom of a respective channel 98. As further noted above, a series of vertical slots 52 extend through body 90 in a row situated in the lower half of body 76. The lower slots 52 are displaced or staggered with respect to the slots 50 and are situated so as to align with the slots 56 of divider member 54 upon assembly of the connector. A notch 102 is formed in each side flange 92 of substantially the same height as locking arm 74 of cover member 58.

Referring to FIGS. 8A–8C in conjunction with FIG. 3, front member 42 has a substantially rectangular frame 103 comprising top and bottom walls 104 and 106 and side walls 108, 110. A partition wall structure 112 includes a horizontal wall 114 extending between side walls 108, 110 having a front edge 116 (FIG. 8C) which is flush with the front edges of the frame 103, and a rear edge 118 that projects rearwardly of the rear edges of the frame 103. The partition wall structure 112 also includes a vertical wall 120 at the rear end of the frame. Horizontal wall 114 is profiled to include a series of upwardly and downwardly projecting, vertically aligned guide walls 122 and 124 extending forwardly and rearwardly from vertical partition wall 120, the portions **122*a* and 124*a* forward of vertical wall 120 being smaller in height than the portions 122*b* and 124*b* rearward of vertical wall 120 and having a stepped configuration. Laterally adjacent pairs of upper guide walls 122 and lower guide walls 124 form upper and lower vertically aligned slots 126 and 128 in which upper and lower contacts 44 and 46 ar mounted as described below. In the illustrated embodiment, there are twenty-five upper slots 126 and twenty-five lower slots 128 vertically aligned with them. The portions 126*a* and 128*a* of contact slots 126 and 128 which are forward of vertical wall 120 communicate with the rearward portions 126*b* and 128*b* of the slots 126 and 128 through respective upper and lower openings 130 and 132 formed through vertical partition wall 120. A pair of locking arms 133 extend rearwardly from side walls 108, 110, each having an inner notch 133*a*. A pair of latch members 134 extend rearwardly from the outside of each of the frame side walls 108, 110**.

Figure 9:
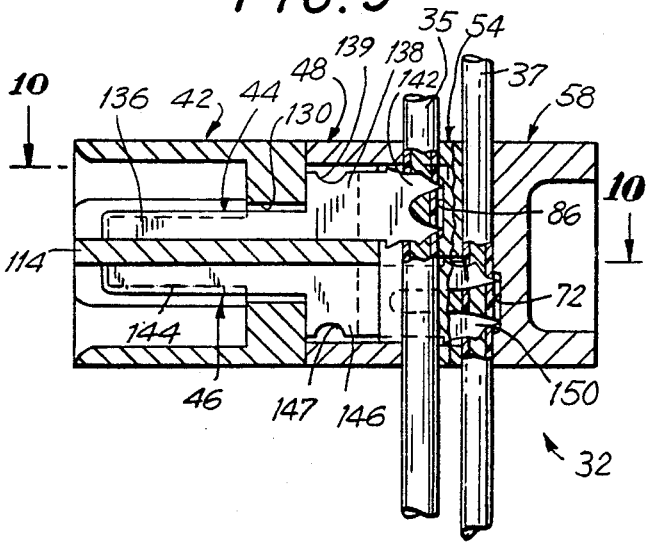
FIG. 9 is a fragmentary section view of the cable-connector assembly taken along line 9—9 of FIG. 4D.
Figure 10:
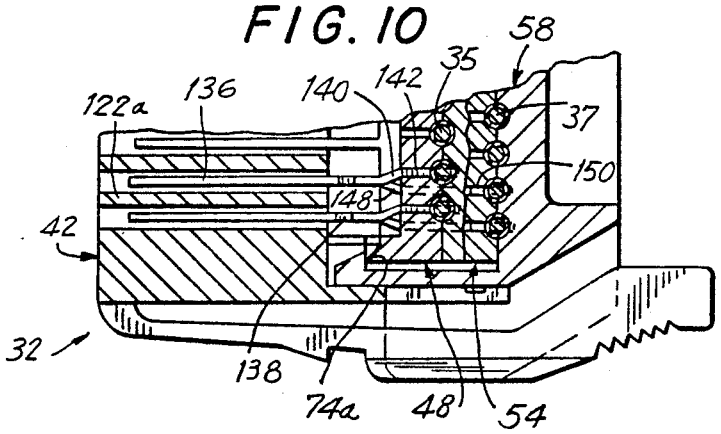
FIG. 10 is a section view of the cable-connector assembly taken along line 10—10 of FIG. 9.

Reference is made to FIGS. 3, 9 and 10 in connection with a description of the short upper and long lower contacts 44 and 46. In the illustrated embodiment, twenty-five short contacts 44 are provided for insertion into the upper contact slots 126 of front member 42 and twenty-five long contacts 46 are provided for insertion into the lower contact slots 128. Each upper short contact 44 includes an elongated contact portion 136, a fixing portion 138 having a notch 139 formed therein, an angular portion 140, and a terminal portion 142, preferably comprising an insulation displacement construction. As seen in FIGS. 3 and 10, the angular portion 140 of each upper contact 44 extends rearwardly towards the left from contact fixing portion 138 so that the contact terminal portion 142 is transversely offset to the left with respect to contact portion 136. Similarly, each lower long contact 46 includes an elongated contact portion 144 and a fixing portion 146 (including a notch 147), substantially identical in construction with corresponding portions of the upper short contacts 44, and angular and terminal portions 148 and 150. However, the angular portions 148 of the lower contacts 48 extend rearwardly to the right as seen in FIGS. 3 and 10 so that the contact terminal portions 150 are transversely offset to the right with respect to contact portions 144. Further, the terminal portions 150 of the contacts 46 are longer than the terminal portions 142 of the upper contacts 44.

Prior to assembling the connector, accomplished simultaneously with the termination of the cable arrangement by the connector, the upper and lower contacts 44 and 46 are pre-inserted into the contact slots 126 and 128 respectively of front member 42. The contact portions 136 and 144 are inserted in the forward direction from the rear of front member 42 as indicated by arrows 152 in FIG. 3 through respective upper and lower openings 130 and 132 in vertical wall 120 and into the forward portions **126*a* and 128*a* of contact slots 126 and 128 until the forward edges of the contact fixing portions 138 and 146 abut against the rear surface of vertical wall 120 (FIG. 9). The respective fixing portions 138 and 146 thus become situated in the portions 126*b* and 128*b* of contact slots 126 and 128 rearward of vertical wall 120**. The dimensions of the contacts and contact slots are such that the contacts fit snugly within the contact slots so that they are securely held in their respective positions.

Figure 4A:
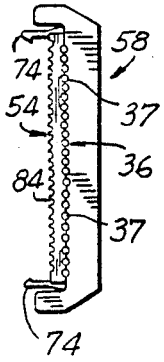
FIGS. 4A–4D are views illustrating the sequential steps in terminating a stacked pair flat cable arrangement to a connector according to the invention to form a cable-connector assembly in accordance with the invention.

Assembly of the connector 32 and the simultaneous termination of the stacked pair cable arrangement 24 to form a connector-cable assembly will now be described with reference to FIGS. 4A–4D in conjunction with FIGS. 3, 9 and 10. A daisy chain termination is described although it is understood that the same procedure will be followed in terminating the end of the cable assembly 24 by connector 28. As seen in FIG. 4A, the cable 36 is initially captured between the front and rear surfaces 70 and 80 of cover member 58 and divider member 54. Each of the conductors 37 of cable 36 is precisely positioned between a respective pair of aligned channels 68 and 82 of the cover and divider members.

Figure 4B:
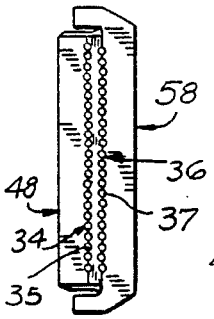

The cable 34 is then captured between the front and rear surfaces 78 and 100 of divider member 54 and guide member 48. Each of the conductors 35 of cable 34 is precisely positioned between a respective pair of aligned channels 84 and 98 of the divider and guide members (FIG. 4B). By virtue of the positions of the aligned channel pairs 68,82 and 84,98, the conductors 35 of cable 34 are positioned in an offset or staggered relationship relative to the conductors 37 of cable 36 so that each conductor 37 of cable 36 is situated directly in back of and aligned with the web of insulation between an adjacent pair of conductors 35 of cable 34. The locking arms 74 of cover member 58 extend through the notches 88 and 102 of divider and guide members 54 and 48 and have locking surfaces 74a which engage the front edges of guide member side flanges 97 to form an interlocked subassembly shown in FIG. 4B.

Figure 4C:
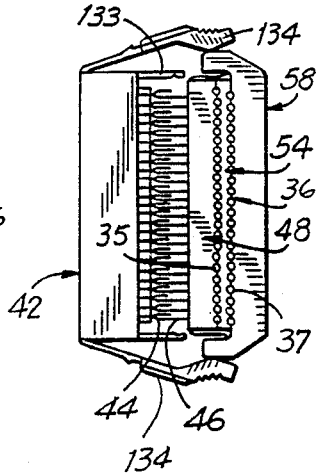
Figure 4D:
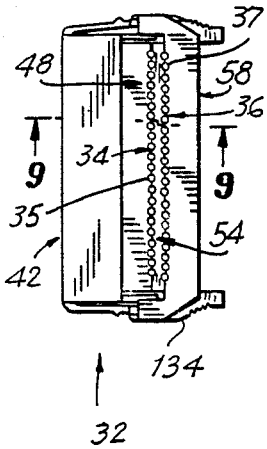

The front member 42 with the upper and lower contacts pre-inserted in contact slots 126 and 128 as described above is then assembled to the subassembly referred to above. As seen in FIG. 4C, the front member 42 and pre-inserted contacts are brought to a position adjacent to the front side of guide member 48 and precisely positioned so that the terminal portions 150 of lower long contacts 46 are axially aligned with and immediately adjacent to the lower guide slots 52 of guide member 48. At the same time, the terminal portions 142 of the upper contacts become axially aligned with upper guide slots 50 of guide member 18. Assembly and cable termination are completed in a last step in which the front member 42 is moved into its assembled position shown in FIG. 4D against the guide member 48 at which point the inner notches 133a of locking arms 133 engage rearwardly facing locking surfaces 74b (FIG. 5B) of cover member locking arms 74 to lock all of the components of the connector together as a single unit.

During the last assembly step, the terminal portions 142 of upper contacts 44 terminate the conductors 35 of first cable 34 while the terminal portions 150 of lower contacts 46 terminate the conductors 37 of second cable 36. More particularly, referring to FIGS. 9 and 10, the terminal portion 150 of each lower contact 46 passes through a respective lower guide slot 52 of guide member 48 which is aligned with the web of insulation between a pair of adjacent conductors 35 of cable 34. The lower contact terminal portion 150 of each lower contact 46, guided by guide slots 52 pierces the insulation web and passes through an aligned slot 56 of divider member 54 into the passage defined between a respective divider member channel 82 and an opposed channel 68 of cover member 58 whereupon it terminates a respective cable conductor 37 of second cable 36 held therein. The pointed ends of terminal portions 150 pass into recesses 72 of cover member 58 and are embedded therein. At the same time, the terminal portion 142 of each upper contact 44 passes through a respective aligned upper guide slot 50 in guide member 48 which opens into the passage defined between a respective guide member channel 98 and an opposed divider member channel 84 whereupon it terminates the respective cable conductor 35 held therein. The pointed ends of terminal portions 142 pass into recesses 86 of the divider member 54 and are embedded therein. Assembly of connector 32 and termination of the cable arrangement 36 is thereby completed with the conductors 35 of first cable 34 terminated by upper contacts 34 while the conductors 37 and second cable 36 are terminated by lower contacts 46. The contacts 44 and 46 are preferably permanently fixed in position by heat staking top and bottom flanges 94 and 96 of guide member 48 into notches 139 and 147 of contact fixing portions 138 and 146.

Figure 11:
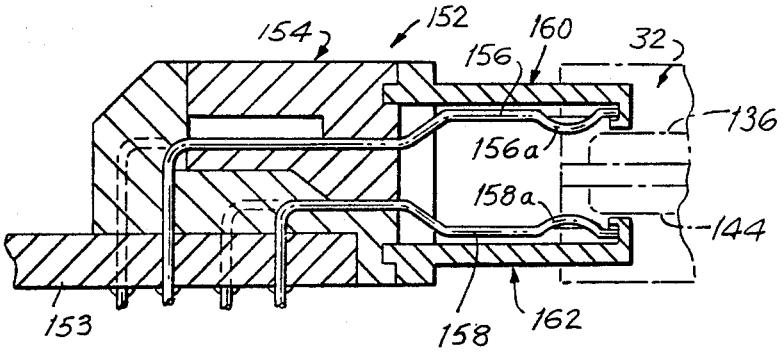
FIG. 11 is a schematic section view of a header connector adapted to mate with a connector in accordance with the invention.

The connector 32 can mate with any complementary connector. For example, referring to FIG. 11, a header-type connector 152 adapted to mate with connector 32 is illustrated for coupling the cable arrangement to circuitry of a printed circuit board 153. The header 152 comprises a housing 154 in which twenty-five upper contacts 156 and twenty-five lower contacts 158 are provided in vertically aligned relationship. The contacts include contact portions 156a and 158a which extend through upper and lower coupling portions 160 and 162 of header housing 154. The connector 32 mates with header 152 by inserting coupling portions 160 and 162 of header 152 in the upper and lower interior spaces 164 and 166 within the frame 103 of front member 42 whereupon the upper and lower contact portions 156a and 158a of header contacts 156 and 158 engage the elongate the contact portions 136 and 144 of upper and lower connector contacts 44 and 46. The unique construction of the connector in accordance with the invention enables the header (or other type of mating connector) to be constructued with a minimum profile or height which is important in many applications. The latch members 134 of connector 32 define latching surfaces 134a which engage corresponding shoulders 167 of header 152 when the connector 32 is connected to the header to securely lock the connector to the header. It is only necessary to squeeze the latch members together to unlock the connector from the header.

It is seen from the foregoing that a connector in accordance with the invention provides efficient end and/or daisy chain termination of flat cable having a large number of conductors. By providing the flat cable in a stacked pair arrangement, the width and inter-conductor spacing can be maintained within conventional limits thereby avoiding space problems and maintaining desired electrical characteristics for the cable. Assembly and termination is quick, easy and reliable and the connector can be used with mating connectors having minimum profiles.

Figure 12:
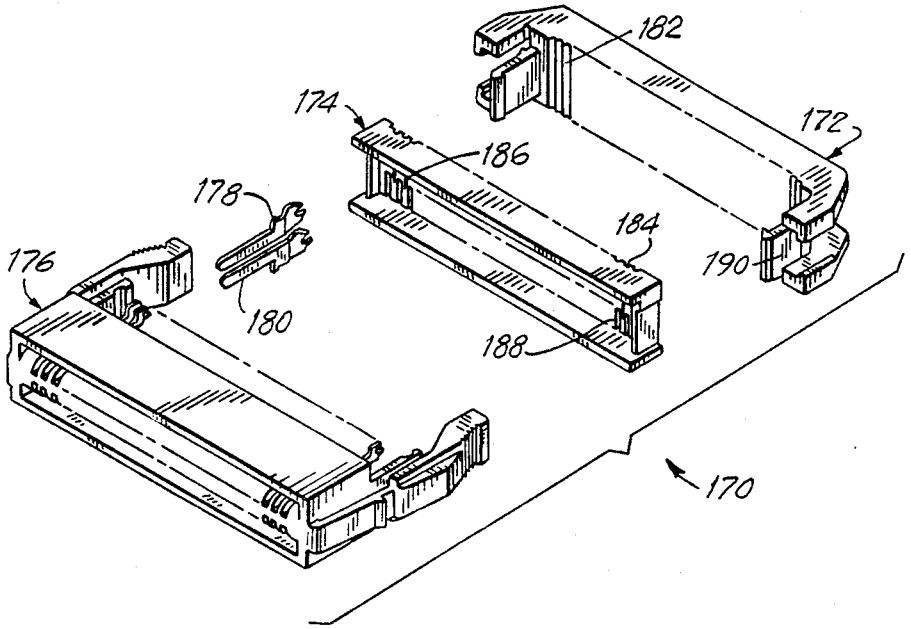
FIG. 12 is an exploded perspective view similar to FIG. 3 of a connector for use in terminating a single flat cable.

Referring to FIG. 12, a somewhat similar construction of a connector 170 is illustrated which is useful in effecting termination of single flat cable having a large number of conductors, e.g., fifty in the illustrated embodiment, either in daisy chain and/or end connections. The connector 170 comprises a cover member 172, a guide member 174 and a front member 176 in which upper and lower contacts 178 and 180 are pre-inserted. The construction of the cover, guide and front members of connector 170 is substantially similar to the construction of the corresponding components of connector 32. Fifty channels 182 are formed in the front wall of cover member 172 and a corresponding number of channels 184 are formed in the rear surface of guide member 174 adapted to align with channels 182 upon assembly. Twenty-five upper slots 186 are formed through guide member 174 opening into one set of alternate ones of channels 184 and twenty-five lower slots 188 are similarly formed in staggered relationship with upper slots 186 and open into the other set of alternate channels 184. The upper and lower contacts 178 and 180 are similar in construction to contacts 44 and 46 respectively except that they are of equal length. In assembly, the fifty conductor cable is positioned between the cover and guide members 172 and 174 which are then locked to each other by locking arms 190 whereby the cable conductors are precisely positioned between respective pairs of opposed channels 182 and 184. Upon assembly and termination, the terminal portions of the upper and lower contacts pass through respective upper and lower guide slots and are guided into engagement with alternate one of the fifty cable conductors.

It will be understood that references herein to directions or orientations, such as references to "top", "bottom", "left", "right", "vertical", and "horizontal", were made with respect to the illustrations in the drawings and are not considered to be limiting in any way. By no means is the invention limited to the particular embodiments illustrated.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A connector for end terminating and/or delay chaining flat multiconductor cable, comprising:

a front member having first contact holding means and second contact holding means;

a guide member mating with said front member and having first and second groups of guide slots formed therethrough, said guide slots of said first group alternating in position with said guide slots of said second group;

a divider member having a plurality of divider slots formed therethrough in alignment with said guide slots of said second group, said divider member mating with said guide member and holding a first flat cable having a multiplicity of parallel first conductors between them;

a cover member mating with said divider member and holding a second flat cable having a multiplicity of second parallel conductors between them;

said guide, divider and cover members having means for positioning said first and second conductors of said first and second cables with their axes extending in the same direction in respective first and second parallel transverse planes spaced from each other, and such that said second conductors alternate in position with said first conductors;

a plurality of first contacts of electrically conductive material, each of said first contacts having a first contact portion situated in said first holding means of said front member, and a rearward terminal portion passing through a respective one of said first group of guide slots of said guide member and engaging a first conductor of said first cable; and a plurality of second contacts of electrically conductive material, each of said second contacts having a forward contact portion situated in said second holding means of said front member, and a rearward terminal portion passing through one of said second group of guide slots of said guide member between a pair of adjacent first conductors, through one of said divider slots of said divider member, and engaging a second conductor of said second cable.

2. A connector as recited in claim 1, wherein, said means for positioning said first conductors of said first cable include a plurality of channels formed in a rear surface of said guide member and a plurality of channels formed in a front surface of said divider member in alignment therewith, each pair of aligned channels forming a first passage in which a respective first conductor is positioned; and wherein said means for positioning said second conductors of said second cable include a plurality of channels formed in a front surface of said cover member and a plurality of channels formed in a rear surface of said divider member in alignment therewith, each pair of aligned channels forming a second passage in which a respective second conductor is positioned.

3. A connector as recited in claim 2 wherein said second passages alternate in position with said first passages.

4. A connector as recited in claim 2 wherein each guide slot of said first group opens onto said rear surface of said guide member within a respective channel formed therein, and each guide slot of said second group opens onto said rear surface of said guide member between a pair of adjacent channels formed therein.

5. A connector as recited in claim 4 wherein each divider slot opens onto said front surface of said divider member between a pair of adjacent channels formed therein, and onto said rear surface of said divider member within a respective channel formed therein.

6. A connector as recited in claim 2 wherein each divider slot opens onto said front surface of said divider member between a pair of adjacent channels formed therein and onto said rear surface of said divider member within a respective channel formed therein.

7. A connector as recited in claim 1 wherein, said first contact holding means of said front member includes a plurality of first contact slots, and wherein said second contact holding means of said front member includes a plurality of second contact slots, and wherein each of said first and second contacts being situated in a corresponding one of said first and second contact slots, respectively.

8. A connector as recited in claim 7 wherein said plurality of first contact slots are situated in a first row and said plurality of second contact slots are situated in a second row substantially parallel to said first row and spaced transversely therefrom.

9. A connector as recited in claim 8 wherein each one of said first contact slots is substantially aligned with a respective one of said second contact slots.

10. A connector as recited in claim 8 wherein said contact slots of at least one of said plurality of first contact slots and said plurality of second contact slots are transversely offset with respect to at least one of said first and second groups of guide slots.

11. A connector as recited in claim 10 wherein each of said first contact slots is transversely offset to one side of a respective first guide slot, and each of said second contact slots is transversely offset to another side of a respective second guide slot.

12. A connector as recited in claim 10 wherein each of said at least one of said plurality of first contacts and said plurality of said second contacts includes an angled portion extending at an angle between said forward contact portion and said rearward terminal portion whereby said contact and terminal portions are transversely offset with respect to each other.

13. A connector as recited in claim 11 wherein each of said first contacts includes an angled portion extending at an angle in one transverse direction between said contact and terminal portions, and wherein each of said second contacts includes an angled portion extending at an angle in another transverse direction between said contact and terminal portions, whereby said terminal portions of said first contacts are transversely offset to one side of said contact portions thereof and said terminal portions of said second contacts are transversely offset to another side of said contact portions thereof.

14. A connector as recited in claim 1 wherein said front member comprises a frame defining an interior and a transversely extending first partition wall within said frame interior substantially separating said interior into first and second spaces.

15. A connector as recited in claim 14 wherein said first contact holding means comprise a plurality of first guide walls extending from said first partition wall into said first interior space defining a plurality of first contact slots in which said first contacts are held; and wherein said second contact holding means comprise a plurality of second guide walls extending from said first partition wall into said second interior space defining a plurality of second contact slots in which said second contacts are held.

16. A connector as recited in claim 14 wherein said front member further comprises a second partition wall within said frame interior extending substantially perpendicularly to said first partition wall substantially separating said interior into forward and rearward spaces.

17. A connector as recited in claim 16 wherein a plurality of first openings are formed in said second partition wall situated in a first row on one side of said first partition wall, and wherein a plurality of second openings are formed in said second partition wall situated in a second row on the other side of first partition wall and wherein said first and second contacts pass through said first and second openings in said second partition wall respectively.

18. A connector as recited in claim 1 wherein a pair of latch members are provided on opposed sides of said front member.

19. A connector as recited in claim 1 wherein said cover member includes first locking means for locking said guide, divider and cover members together to form a subassembly.

20. A connector as recited in claim 19 wherein said front member includes second locking means for locking said front member to said subassembly.

21. A connector for end terminating and/or daisy chaining an arrangement of a stacked pair of layers of conductors, each conductor layer including a plurality of conductors extending in substantially the same direction and situated in substantially the same plane, comprising:

means for positioning a first conductor layer in substantially overlying relationship with a second conductor layer;

a plurality of first contacts having forward contact portions and rearward terminal portions;

a plurality of second contacts having forward contact portions and rearward terminal portions;

means for holding said plurality of first contacts with said terminal portions thereof engaging said conductors of said first layer; and means for holding said plurality of second contacts with said terminal portions of at least some of said second contacts passing through said first conductor layer between said conductors thereof and engaging said conductors of said second layer.

22. A connector as recited in claim 21 wherein said forward contact portions of said first and second contacts are situated in respective substantially parallel rows.

23. A connector as recited in claim 22 wherein said forward contact portions of said first contacts are substantially aligned with said forward contact portions of said second contacts.

24. A connector as recited in claim 21 wherein said second contacts are greater in length than said first contacts.

25. A connector as recited in claim 21 wherein a rearward terminal portion of each of at least some of said second contacts pass between a pair of adjacent conductors of said first cable piercing a web of insulation extending therebetween.

26. A connector as recited in claim 21 wherein said conductor layer positioning means position said first and second conductor layers so that conductors of said second conductor layer are situated substantially between conductors of said first conductor layer.

27. A connector for end terminating and/or daisy chaining flat multiconductor cable, comprising:

a plurality of first contacts having forward contact portions and rearward terminal portions;

a plurality of second contacts having forward contact portions and rearward terminal portions;

a front member having means for holding said plurality of first contacts with said contact portions thereof situated in a first row and means for holding said plurality of second contacts with said contact portions thereof situated in a second row parallel to and spaced from said first row;

a guide member mating with said front member and having first and second groups of guide slots formed therethrough, said guide slots of said first group alternating in position with said guide slots of said second group;

a cover member mating with said guide member for holding a flat cable having a multiplicity of parallel conductors between them;

said guide and cover members having means for positioning said cable conductors such that a first group of alternating conductors are aligned with said first group of guide slots and a second group of alternating conductors are aligned with said second group of guide slots; and wherein said terminal portions of said first contacts pass through said first group of guide slots and engage said first group of alternating cable conductors and said terminal portions of said second contacts pass through said second group of guide slots and engage said second group of alternating cable conductors.

28. A connector as recited in claim 27 wherein said contact portions of said first contacts are in substantial alignment with said contact portions of said second contacts.

29. A connector as recited in claim 28 wherein said terminal portions of said first contacts are transversely offset in one direction relative to said contact portions thereof and wherein said terminal portions of said second contacts are transversely offset in another direction relative to said contact portions thereof.

30. A cable-connector assembly, comprising:

an arrangement of first and second layers of conductors, each conductor layer including a plurality of conductors extending in substantially the same direction and situated in substantially the same plane;

a connector including, means for positioning said first conductor layer in substantially overlying relationship with said second conductor layer;

a plurality of first contacts having forward contact portions and rearward terminal portions;

a plurality of second contacts having forward contact portions and rearward terminal portions;

means for holding said plurality of first contacts with said terminal portions thereof engaging said conductors of said first conductor layer; and means for holding said plurality of second contacts with said terminal portions of at least some of said second contacts passing through said first conductor layer between said conductors thereof and engaging said conductors of said second conductor layer.

* * * * *